US007415949B2

(12) United States Patent
Carlsson et al.

(10) Patent No.: US 7,415,949 B2
(45) Date of Patent: Aug. 26, 2008

(54) CYLINDER FOR A CRANKCASE SCAVENGED INTERNAL COMBUSTION ENGINE

(75) Inventors: Bo Carlsson, Alingsås (SE); Pär Martinsson, Jönköping (SE); Mikael Holmdahl, Jönköping (SE); Ulf Olander, Odeshog (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 10/581,878

(22) PCT Filed: Dec. 19, 2003

(86) PCT No.: PCT/SE03/02020

§ 371 (c)(1),
(2), (4) Date: Apr. 27, 2007

(87) PCT Pub. No.: WO2005/059344

PCT Pub. Date: Jun. 30, 2005

(65) Prior Publication Data

US 2008/0035096 A1 Feb. 14, 2008

(51) Int. Cl.
*F02B 25/00* (2006.01)

(52) U.S. Cl. ..... 123/73 PP; 123/73 A

(58) Field of Classification Search ..... 123/73 A, 123/73 AA, 73 PP

See application file for complete search history.

(56) References Cited

U.S. PATENT DOCUMENTS 6,712,029 B1 3/2004 Andersson et al.
7,082,910 B2 * 8/2006 Carlsson et al. ..... 123/73 PP
2002/0043227 A1 4/2002 Carlsson et al.
2003/0106507 A1 6/2003 Olander

FOREIGN PATENT DOCUMENTS

WO WO 00/43660 A1 7/2000

* cited by examiner

*Primary Examiner*—Noah Kamen
(74) *Attorney, Agent, or Firm*—Pearne & Gordon LLP

(57) ABSTRACT

A cylinder (1) for a crankcase scavenged two-stroke engine, comprising a cylinder bore (2) with centre line (12) and on opposite sides of the cylinder located closed transfer ducts (3, 3'), which cylinder (1) has an underside (4) essentially perpendicular towards the cylinder bore (2), intended to be connected to a crankcase (5) in a parting plane (A), and besides an inlet (8) for air/fuel mixture, the cylinder is provided with at least one inlet (9, 9') for additional air to the combustion chamber, which inlet for additional air runs through a cylinder wall (11) and via a recess in the piston and a transfer port (6, 6') leads down into the transfer ducts (3, 3'). Especially the transfer ducts (3,3') each have an upper section (3*a*, 3*a'*) leading from the transfer port (6, 6') and in a tangential direction in relation to the cylinder bore (2) and is followed by an essentially right angled bend (3*b*, 3*b'*) leading into a lower section (3*c*, 3*c'*) leading into the parting plane (A), and at least the right-angled bend of each transfer duct is located on opposite sides of an exhaust duct (7) and during at least a part of the right-angled bend (3*b*, 3*b'*) the transfer ducts approach each other.

10 Claims, 5 Drawing Sheets

CYLINDER FOR A CRANKCASE SCAVENGED INTERNAL COMBUSTION ENGINE

TECHNICAL FIELD

The subject invention refers to a cylinder (1) for a crankcase scavenged two-stroke engine, comprising a cylinder bore with centre line and on opposite sides of the cylinder located closed transfer ducts, which cylinder (1) has an underside essentially perpendicular towards the cylinder bore, intended to be connected to a crankcase in a parting plane (A), and besides an inlet for air/fuel mixture, the cylinder is provided with at least one inlet for additional air to the combustion chamber, which inlet for additional air runs through a cylinder wall and via a recess in the piston and a transfer port leads down into the transfer ducts. The cylinder is primarily intended for a handheld working tool.

BACKGROUND OF THE INVENTION

A difficulty regarding crankcase-scavenged engines is to provide a homogeneous air-fuel mixture to the combustion chamber. This can be achieved by so called long transfer ducts, which however tends to make the crankcase complicated and bulky. For two-stroke engines provided with additional air to the transfer ducts it is important to keep the air in the transfer ducts separated from the air-fuel mixture, in order to as far as possible prevent the air-fuel mixture from the transfer ducts to disappear out through the exhaust port. This separation, also called stratification, is promoted by making the transfer ducts long and narrow, thus preventing, or at least reducing, mixing of different scavenging gases.

The length is also adapted to the desired performance of the tool and its engine. Long transfer ducts for high torque at low speed and shorter ducts for high torque at high speed. A cylinder of the above-mentioned kind is connected to the crankcase in a parting plane essentially perpendicular towards the cylinder bore, usually with a sealing intermediate layer, such as a gasket. Either the parting plane can be located entirely above the center axis of the crankshaft bearing, a so called "short" cylinder, or the parting plane can be located essentially as high as the center axis of the crankshaft, a so called "long" cylinder.

In engines provided with additional air to the transfer ducts, as well as in conventional, high-performance engines, the transfer ducts are closed, i.e. they are separated from the cylinder bore by means of an intermediate wall. Usually closed transfer ducts are vaulted out from the cylinder body for providing the scavenging gases a desired direction into and out from the cylinder bore. This design will lead to difficulties at die-casting of the cylinder body since the direction of the transfer ducts will vary. However US 2003/0106507 A1 shows a cylinder of this type. Each transfer duct runs in a radial direction away from its transfer port and has a vaulted top part and lower part parallel with the cylinder bore. This cylinder is possible to die cast, but it has some clear disadvantages. The flow of additional air from the inlet via the piston recess and the transfer port and down into the transfer channel is slowed down by a number of sharp bends that creates a high flow resistance. From the piston recess there is first a 90° bend into the upper radial part of the transfer duct followed by a 90° bend down to the bore—parallel section of the duct. This creates a high flow resistance that reduces the amount of additional air that can be added, and therefore also the available reduction of exhaust emissions. Further these bends are also followed by a sharp bend in the parting plane.

US 2002/0043227 A1 shows a cylinder with a transfer duct that leads from the transfer port in a tangential direction. Thereafter follows a very strong bend, more than 150 degrees, to make the transfer duct meet the parting plane almost directly below the transfer port. A cutout in the lowest part of the cylinder opens each transfer duct directly in the parting plane. The tangential flow from the transfer port is an advantage compared to US 2003/0106506 A1, but the shape of the other parts of the transfer ducts results in a number of drawbacks:

- The strong bend, more than 150 degrees results in a fairly high flow resistance.
- The transfer duct will meet the crankcase in a very oblique angle, resulting in high flow resistance.
- The transfer duct will lye on the side of the cylinder below the transfer port. This will restrict the flow of cooling air around the cylinder.
- The transfer duct will not continue in the crankcase, but will open up in the parting plane. Therefore it is not possible to adapt its total length by just adapting the crankcase. The crankcase is more specifically connected to each tool application than the cylinder is.

SUMMARY OF THE INVENTION

The purpose of the subject invention is to take away or at least reduce the above outlined disadvantages.

This purpose is achieved in a cylinder of the initially mentioned kind, wherein the transfer ducts each have an upper section leading from the transfer port and in a tangential direction in relation to the cylinder bore and is followed by an essentially right angled bend leading into a lower section leading into the parting plane (A), and at least the right angled bend of each transfer duct is located on opposite sides of an exhaust duct, and during at least a part of the right-angled bend (3*b*, 3*b*') the transfer ducts approach each other.

This design has a number of advantages over the mentioned prior art documents. Because the transfer channels make only a 90° bend and that they approach each other they will meet the parting plane approximately below the exhaust duct. Thereby they restrict the airflow less, and they are shorter and meet the parting plane in a less oblique angle than US 2002/0043227 A1. All this reduces the flow resistance and it is also easier to use one cylinder with different crankcases for different applications, because it is simpler to adapt the total length of the transfer channels by adapting only the transfer channel length in the crankcase.

According to an embodiment the transfer ducts over at least some part of their length above the parting plane are parallel with the cylinder bore. Owing to this design of the transfer ducts, die-casting of the cylinder will be simplified, and this is also a preferred way of manufacturing. An exterior covering element could then, after the die-casting process, be arranged over an open part of each transfer duct.

This covering element is also creating a bent exterior wall of the transfer duct in order to reduce the flow resistance at the transition between the transfer port and an upper section of the transfer duct leading from the port in a tangential direction in relation to the cylinder bore.

BRIEF DESCRIPTION OF THE DRAWINGS

The invention will be described in the following with reference to the accompanying drawing figures, which in the purpose of exemplifying are showing preferred embodiments of the invention. Many parts are arranged symmetrically in pairs. They are numbered with and without a prime note, e.g. transfer ducts 3, 3'.

DETAILED DESCRIPTION OF PREFERRED EMBODIMENTS

Figure 1:
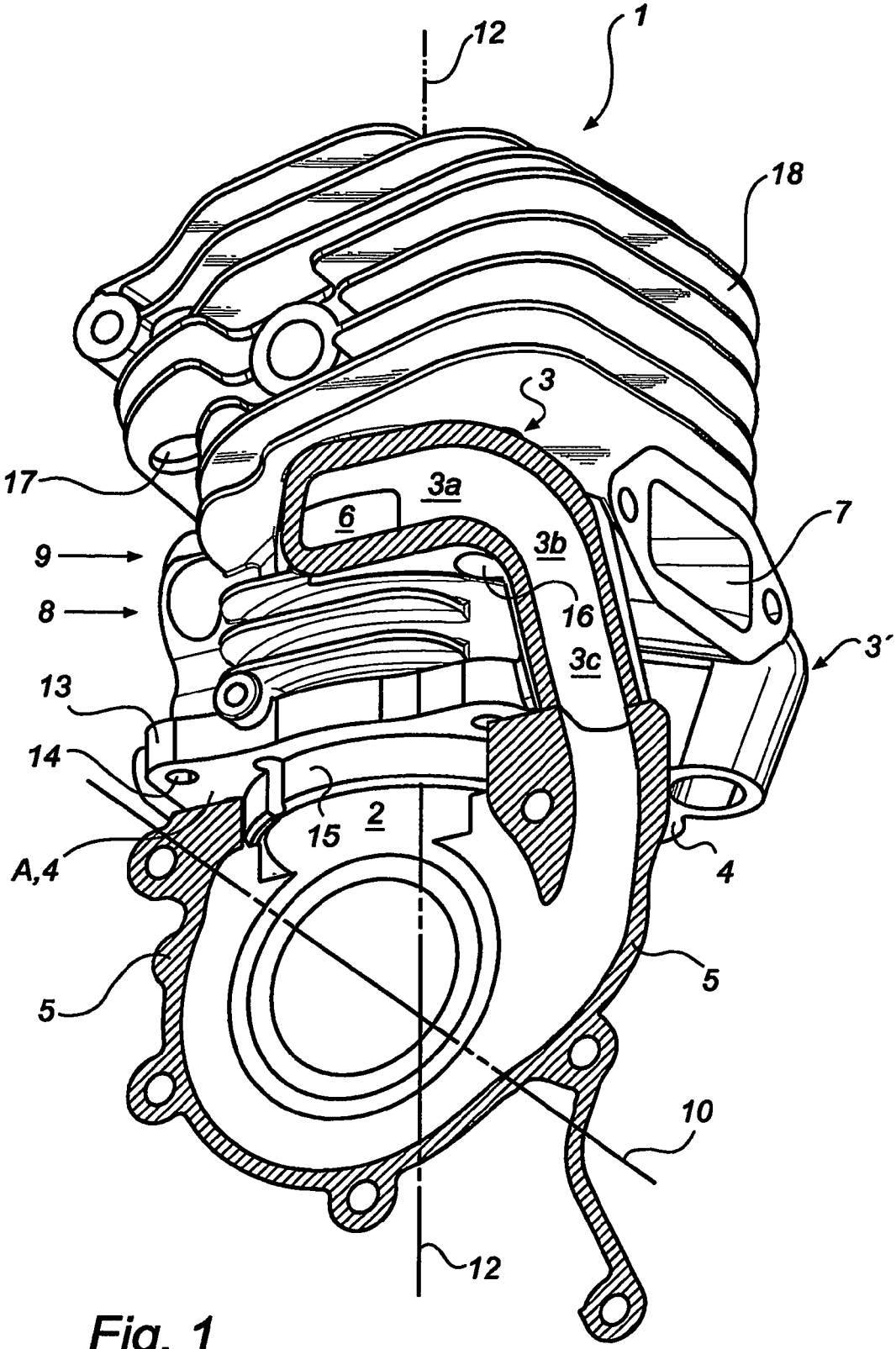
FIG. 1 illustrates in perspective, obliquely from below and behind, a cylinder according to a first embodiment of the invention. A partial cross-section is arranged through the transfer duct.

With reference to FIG. 1 a cylinder according to a first embodiment of the invention is shown. The cylinder has a cylinder bore 2, in which a piston (not shown) is intended to be movable, an inlet 8 for air/fuel mixture, indicated by arrow 8, and adapted for connection to a carburettor via an inlet tube (not shown), as well as an exhaust duct 7 adapted for connection to a muffler. The entire cylinder is surrounded by cooling fins 18, and at its lower edge a stronger flange 13 is arranged and intended, by means of attachment devices, such as bolts running through holes 14, to be firmly connected to a crankcase. The underside 4 of the flange, which will be described in closer detail in the following, is located in an imagined parting plane A between the cylinder 1 and a at the cylinder firmly connected crankcase 5, consisting of two halves, in a conventional way. The cylinder bore 2 continues a bit below the flange in that a collar 15 extends pass by the parting plane A. This collar 15 serves as guidance of the cylinder bore 2 in relation to the crankcase 5. In the parting plane A usually a gasket (not shown) of some kind is arranged, for sealing between cylinder 1 and crankcase 5.

The cylinder comprises two, on each side of an exhaust duct 7 located transfer ducts 3, 3'. The transfer ducts 3, 3' connect in the conventional way transfer ports 6, 6' in the cylinder wall with transfer openings in the crankcase 5.

Furthermore the cylinder 1 has two, obliquely above the inlet 8 located inlets 9, 9', indicated by arrows 9, 9', for additional air. These inlets 9, 9' are in a known way arranged via recesses in the piston to be connected to the transfer ports 6, 6' when the piston is located close to its top dead center. In this position additional air can be supplied into the transfer ducts 3, 3' in order to try to prevent the air/fuel mixture from the transfer ducts to follow, together with exhaust gases, out through the exhaust duct 7.

As can be seen from the figure each transfer duct 3, 3' first run in a tangential direction in relation to the cylinder bore 2. This mainly happens in an upper section 3*a*, 3*a*'. It is followed by an essentially right-angled bend 3*b*, 3*b*' that leads into a lower section 3*c*, 3*c*'. This lower section ends in the parting plane A. At least the right-angled bend of each transfer duct is located on opposite sides of the exhaust duct 7. At least from the right-angled bend 3*b*, 3*b*' and during at least a part of the lower section 3*c*, 3*c*' the transfer ducts approach each other. It could be stated that the transfer ducts lies in two planes that are tangential with the cylinder in their upper part and that constantly approach each other downwards, see FIG. 2. Therefore the lower section 3*c*, 3*c*' at least partly reaches the parting plane A below the exhaust duct 7. As this is a short cylinder the parting plane A is located higher, and even essentially higher, than the centre axis of the crankshaft 10. The lower section 3*c*, 3*c*' reaches the parting plane A in an approximately right angle as seen from the side of the cylinder, but in an oblique angle as seen from the back of the cylinder, i.e. as seen towards the exhaust duct 7. Compare FIG. 2, where this is clearly notable. The lower end of the lower section is adapted to be sealably connected to the crankcase in the parting plane. It forms part of the parting plane A.

Figure 2:
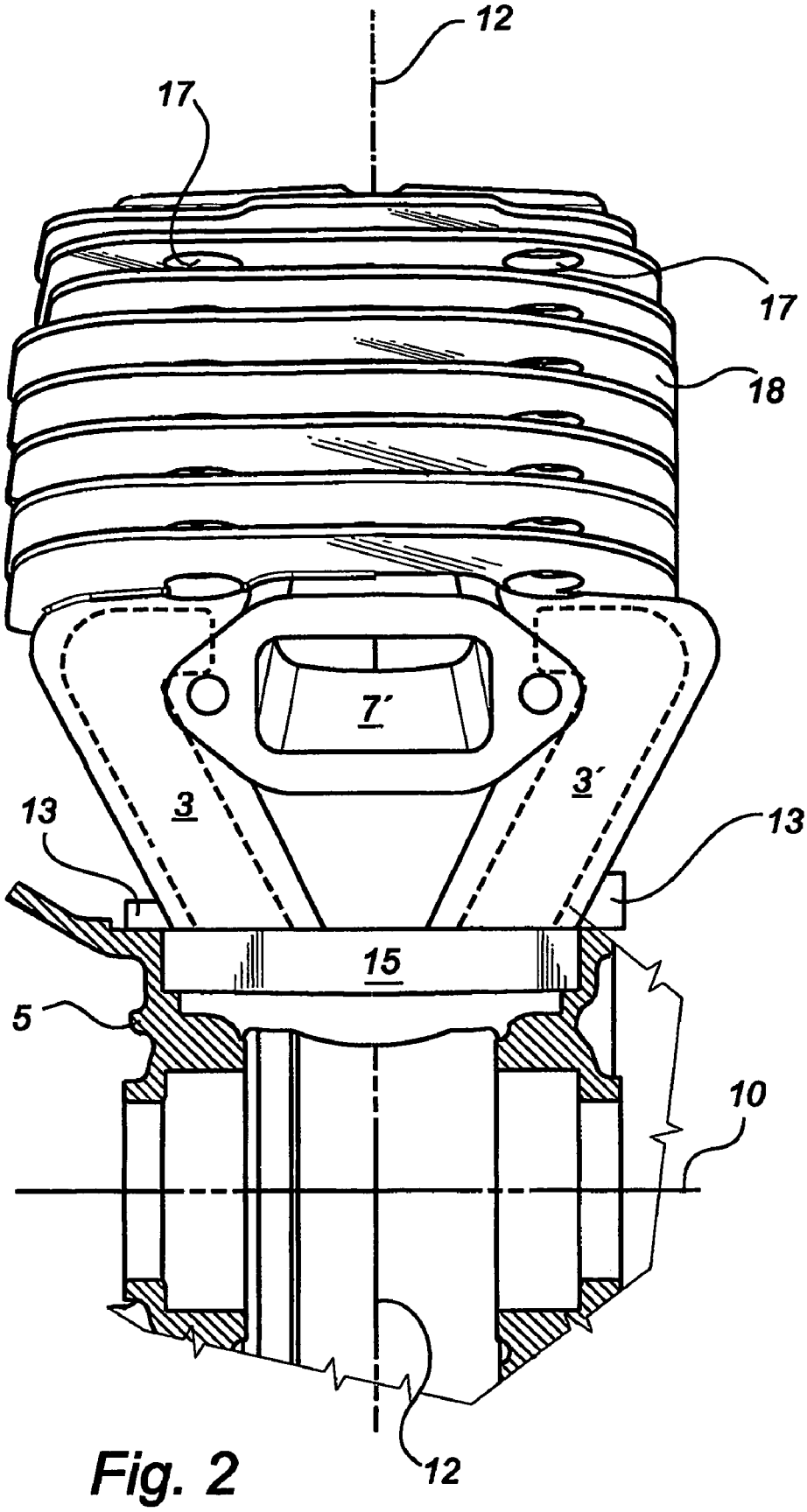
FIG. 2 illustrates schematically the cylinder according to FIG. 1, as seen from behind towards an exhaust duct.

For fastening the cylinder to the crankcase 5, as indicated in FIG. 2, there are holes 14 in the stronger flange 13, screws are inserted through these holes 14, and fastened in the crankcase 5. To reach these screws with a screwdriver there are apertures 16 inside of each transfer duct and also apertures 17 in every cooling fin 18 projecting over the screw holes 14. Especially the apertures 16 will decrease the weight of the cylinder and increase its cooling. Therefore the apertures 16 and 17 are made as big as possible.

Figure 3:
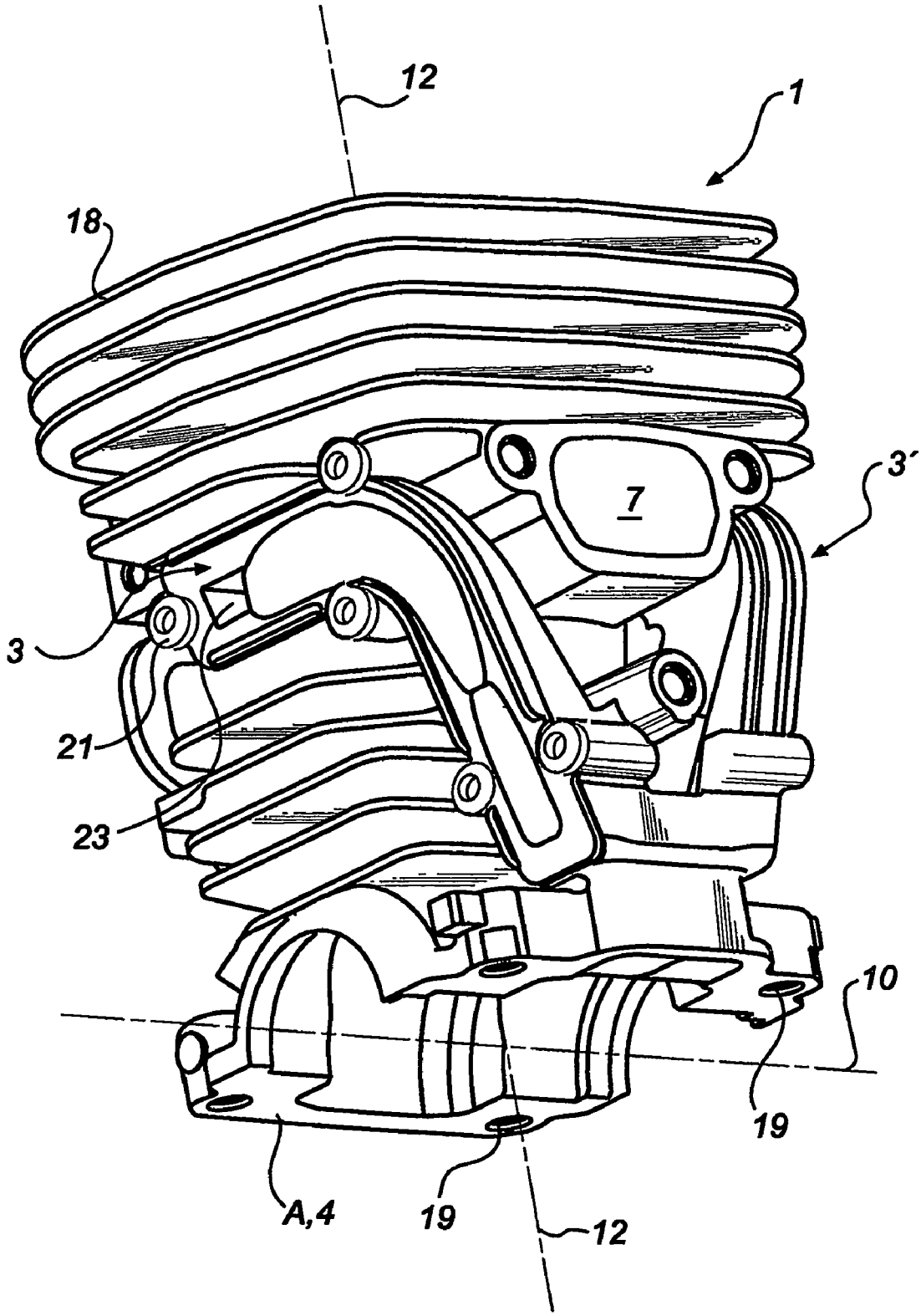
FIG. 3 illustrates in perspective, obliquely from behind and below a cylinder according to a second embodiment of the invention.

FIG. 3 shows a perspective view of a second embodiment of the invention. It is a long cylinder wherein the parting plane A is located essentially as high as the centre axis of the crankshaft 10. A number of screw holes 19 are shown in the parting plane A. Screws are inserted through the crankcase (not shown) and secured in the screw holes 19. This cylinder is manufactured by die-casting. This has been achieved by making the transfer channels 3, 3' open in a direction away from the centre of the cylinder. Instead a cover or lid 20, 20' is fastened to the partly open transfer channel and thereby making it a closed channel. This cover or lid can be arranged to cover almost all of the transfer duct or only a part of it. The cover can be arranged over an open part of each transfer duct 3, 3' comprising the upper section 3*a*, 3*a*' and at least a part of the right-angled bend 3*b*, 3*b*' as a minimum, compare FIG. 4 that shows the different sections. However, the cover can also be arranged over an open part of each transfer duct comprising the upper section 3*a*, 3*a*', the right-angled bend 3*b*, 3*b*' and at least a part of the lower section 3*c*, 3*c*' as shown in FIG. 3-5.

It is important that the covers 20, 20' will be tightly fastened over the open part of each transfer duct. Therefore they are fastened by many screws 21, 21' that are divided around the parameter of each cover. Also a recess 22, 22' is formed around the parameter of each open part of the transfer duct. A form-moulded rubber sealing is arranged in this recess or ditch to seal between the cover and the very cylinder. It can also be observed that there is a depression 23, 23' in each cover. This depression forms a filling on its inside that rounds off the square shape of the die-casting at the front part of the transfer duct. This will smooth the gas flow by making a smooth transition from the port 6, 6' over to the tangential upper section 3*a*, 3*a*'. A similar depression can also be arranged in-the lowest part of the cover.

The two transfer ducts 3, 3' meet each other approximately where each cover ends and run together down into the parting plane A. Therefore the transfer ducts 3, 3' over at least a part of their length above the parting plane A are parallel with the cylinder bore 2. This makes die-casting easier.

Figure 4:
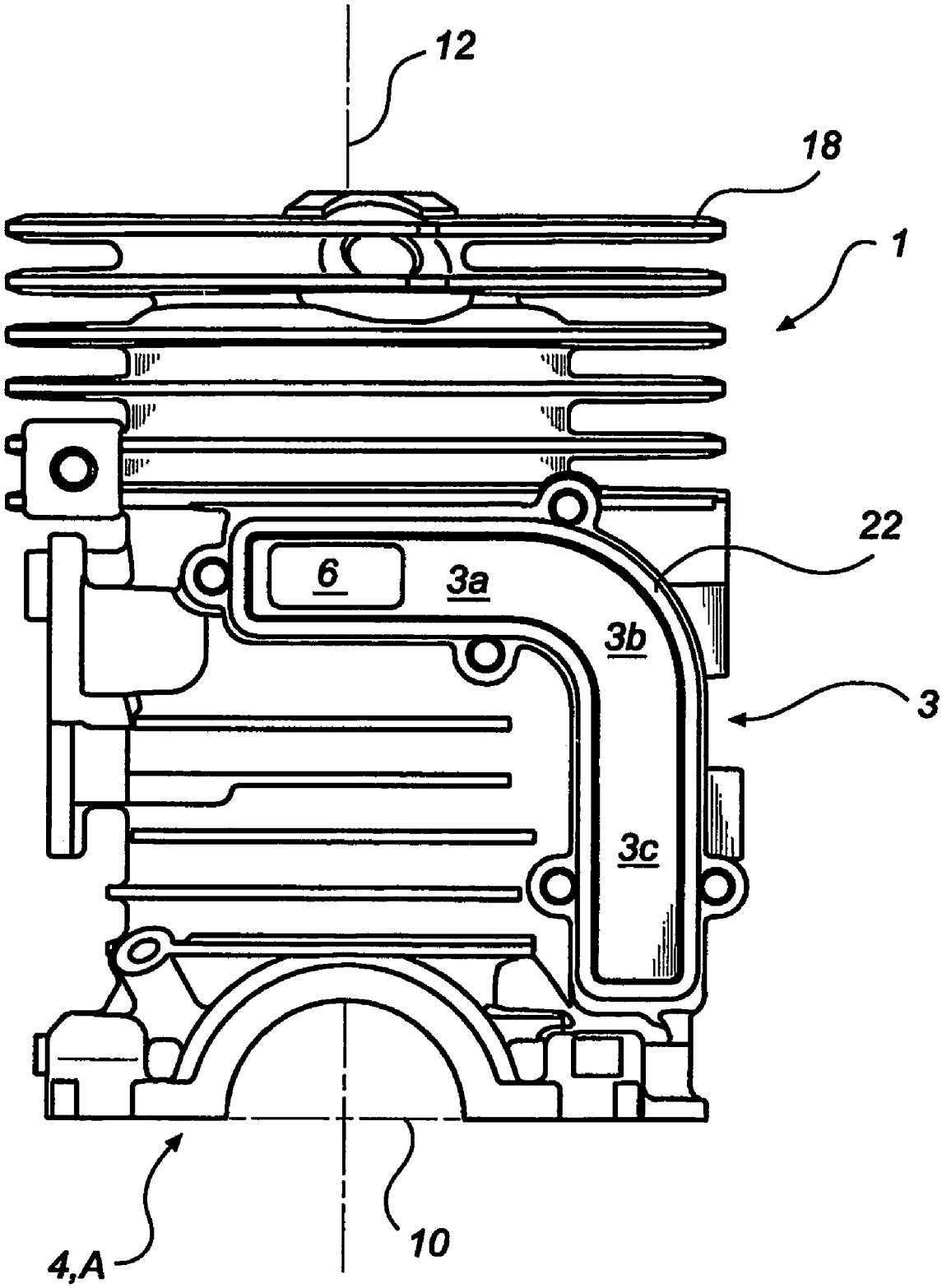
FIG. 4 shows a plane view from the side of the cylinder according to FIG. 3.
Figure 5:
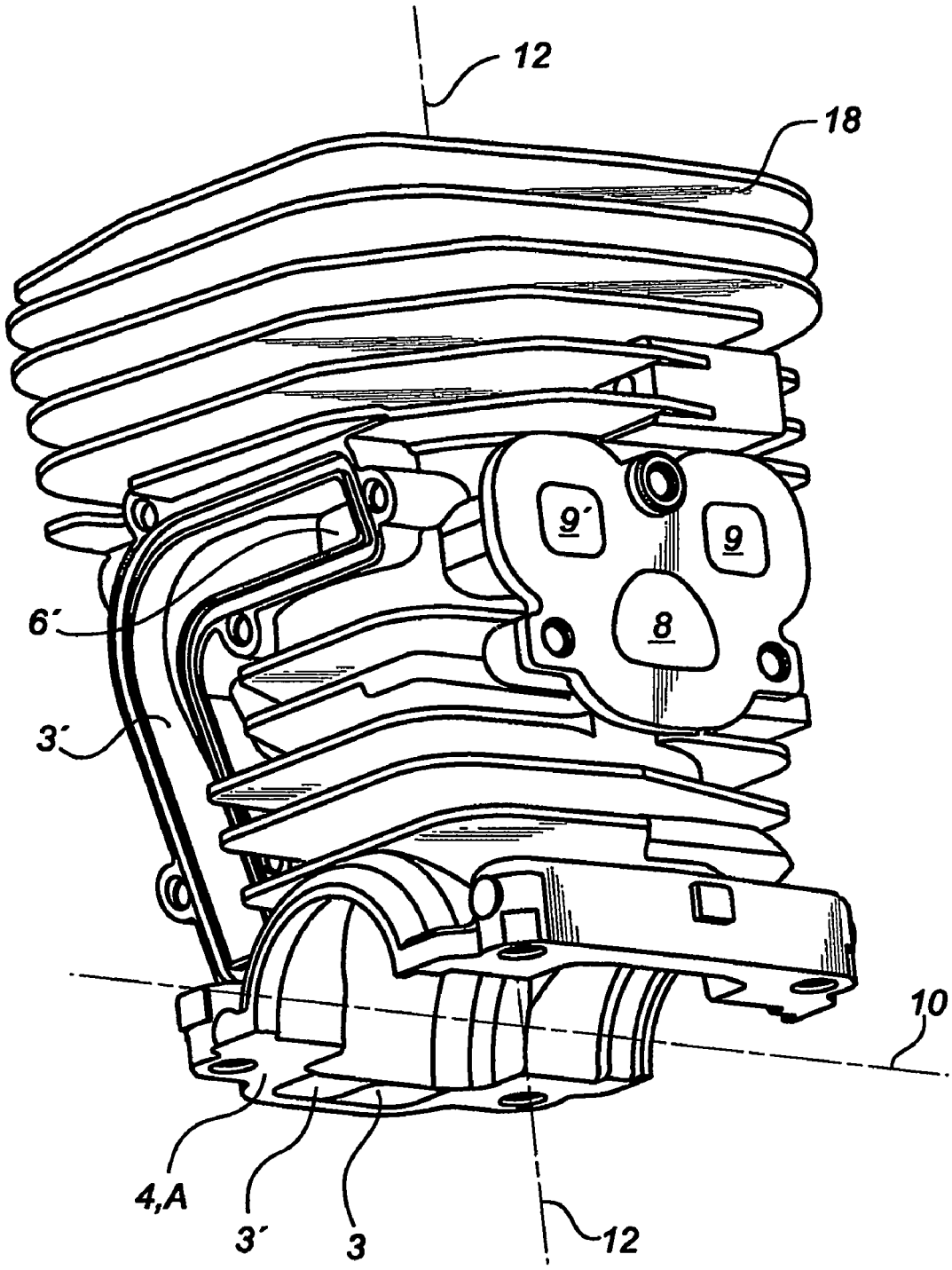
FIG. 5 shows in perspective, obliquely from front and below, the cylinder of FIGS. 3 and 4.

The manufacturing of the cylinder 1 according to FIG. 3-5 preferably takes place by die-casting. The first, open part, of the transfer duct can hereby be formed by means of a first set of slides, arranged to be leadable radially out from the center axis of the cylinder. The second, essentially vertical sections, i.e. the lowest part of the lowest section 3, 3', can in the corresponding way be formed by means of a second set of slides, arranged to be movable in the longitudinal direction of the cylinder. The above mentioned second set of slides will be pulled out from the cylinder through the underside 4.

The cylinder of FIGS. 1 and 2 is made by chill-casting which is more time-consuming and therefore more costly. However, also this cylinder can be die cast. In that case the major part of the transfer ducts will need to be open outwards and covered by lids as in the second embodiment.

It is obvious that a number of variations are conceivable within the scope of the appended patent claims, and that the above-mentioned descriptions of preferred embodiments should only be regarded as examples. E.g. the design of the transfer ducts can be varied in many different ways, and also the cylinder and the crankcase can vary regarding geometry and fit. The arrangement for supply of additional air down into the scavenging ducts can also be arranged in different ways.

The invention claimed is:

1. A cylinder (1) for a crankcase scavenged two-stroke engine, comprising a cylinder bore (2) with centre line (12) and on opposite sides of the cylinder located closed transfer ducts (3, 3'), which cylinder (1) had an underside (4) essentially perpendicular towards the cylinder bore (2), intended to be connected to a crankcase (5) in a parting plane (A), a besides an inlet (8) for air/fuel mixture, the cylinder is provided with at least one inlet (9, 9') for additional air to the combustion chamber, which inlet for additional air runs through a cylinder wall (11) and via a recess in the piston and a transfer port (6, 6') leads down into the transfer ducts (3, 3'), characterized in that said transfer ducts (3, 3') each have an upper section (3*a*, 3*a'*) leading from the transfer port (6, 6') and in a tangential direction in relation to the cylinder bore (2) and is followed by an essentially right angled bend (3*b*, 3*b'*) leading into a lower section (3*c*, 3*c'*) leading into the parting plane (A), and at least the right-angled bend of each transfer duct is located on opposite sides of an exhaust duct (7) and during at least a part of the right-angled bend (3*b*, 3*b'*) the transfer ducts approach each other.

2. A cylinder according to claim 1, wherein the transfer ducts approach each other also during at least a part of the lower section (3*c*, 3*c'*).

3. A cylinder according to claim 1 or 2, wherein the lower end of the lower section (3*c*, 3*c'*) is adapted to be sealably connected to the crankcase (5) in the parting plane, so that the transfer duct can continue in the crankcase.

4. A cylinder according to claim 1, wherein the lower section (3*c*, 3*c'*) at least partly reaches the parting plane (A) below the exhaust duct (7).

5. A cylinder according to claim 1, wherein the parting plane (A) is located higher than the centre axis of the crankshaft (10).

6. A cylinder according to claim 1, wherein the parting plane (A) is located essentially as high as the centre axis of the crankshaft (10).

7. A cylinder according to claim 1, wherein a cover (20, 20') is arranged over an open part of each transfer duct (3, 3') comprising the upper section (3*a*, 3*a'*) and at least a part of the right-angled bend (3*b*, 3*b'*).

8. A cylinder according to claim 1, wherein a cover is arranged over an open part of each transfer duct (3, 3') comprising the upper section (3*a*, 3*a'*) the right angled (3*b*, 3*b'*) and at least a part of the lower section (3*c*, 3*c'*).

9. A cylinder according to claim 1, wherein the transfer ducts (3, 3') over at least a part of their length above the parting plane (A) are parallel with the cylinder bore.

10. A cylinder claim 1 whereby the cylinder (1) is die-cast.

* * * * *